US010344421B2

(12) United States Patent
Cinello et al.

(10) Patent No.: US 10,344,421 B2
(45) Date of Patent: Jul. 9, 2019

(54) WASHING MACHINE WITH DRAWER ASSEMBLY

(71) Applicant: Electrolux Appliances Aktiebolag, Stockholm (SE)

(72) Inventors: Mauro Cinello, Codroipo (IT); Daniele Da Riol, Cordenones (IT)

(73) Assignee: Electrolux Appliances Aktiebolag (SE)

( * ) Notice: Subject to any disclaimer, the term of this patent is extended or adjusted under 35 U.S.C. 154(b) by 493 days.

(21) Appl. No.: 15/036,920

(22) PCT Filed: Nov. 13, 2014

(86) PCT No.: PCT/EP2014/074523

§ 371 (c)(1),
(2) Date: May 16, 2016

(87) PCT Pub. No.: WO2015/074954

PCT Pub. Date: May 28, 2015

(65) Prior Publication Data

US 2016/0286958 A1 Oct. 6, 2016

(30) Foreign Application Priority Data

Nov. 25, 2013 (EP) ..... 13194189

(51) Int. Cl.
*A47B 88/57* (2017.01)
*D06F 39/02* (2006.01)
(Continued)

(52) U.S. Cl.
CPC ..... *D06F 39/14* (2013.01); *A47B 88/57* (2017.01); *D06F 39/02* (2013.01); *D06F 39/12* (2013.01)

(58) Field of Classification Search
CPC ..... A47B 88/57; D06F 39/02; D06F 39/12; D06F 39/14
(Continued)

(56) References Cited

U.S. PATENT DOCUMENTS 3,782,800 A 1/1974 Remington et al.
2009/0261697 A1 10/2009 Hill et al.

FOREIGN PATENT DOCUMENTS

EP 2003237 A1 12/2008
EP 2372011 A1 10/2011
(Continued)

OTHER PUBLICATIONS

International Search Report dated Feb. 17, 2015 issued in corresponding international application No. PCT/EP2014/074523.

*Primary Examiner* — Levon J Shahinian
(74) *Attorney, Agent, or Firm* — RatnerPrestia

(57) ABSTRACT

A washing machine (100) has a drawer (1) having at least one compartment (10*a*, 10*b*, 10*c*, 10*d*) for receiving an agent for treating laundry, a supporting structure (2) on which the drawer can slide and a removable retaining device (4) connectable to the supporting structure for delimiting a movement of the drawer with respect to the supporting structure. The removable retaining device is connected to the supporting structure by moving the removable retaining device along a fixing direction. The supporting structure has an engagement element (220) and the removable retaining device has a releasable locking element (420) engaging with the engagement element such that, when the removable retaining device is moved along the fixing direction in order to be connected to the supporting structure, the releasable locking element locks the retaining device in a connected condition.

18 Claims, 12 Drawing Sheets

(51) Int. Cl.
*D06F 39/12* (2006.01)
*D06F 39/14* (2006.01)

(58) Field of Classification Search
USPC ..... 68/17 R; 312/333, 334.47
See application file for complete search history.

(56) References Cited

FOREIGN PATENT DOCUMENTS

| | | | |
|---|---|---|---|
| EP | 2617888 | A1 | 7/2013 |
| GB | 758944 | A | 10/1956 |

WASHING MACHINE WITH DRAWER ASSEMBLY

FIELD

A washing machine, or a washing machine having dryer function, having a drawer for receiving a laundry treating agent, a supporting structure on which said drawer can slide and a removable retaining device configured to delimit a movement of the drawer with respect to the supporting structure.

BACKGROUND

Conventionally, laundry washing machines include a drawer for receiving a detergent agent or other agents for treating the laundry, such as softener or bleach, to be used during the washing cycles.

During the use of the laundry washing machines, residual of such agents for treating the laundry may remain in the drawer and, for this reason, it is advisable to periodically rinse out with water the drawer.

For this purpose, the drawer of conventional laundry washing machines can be fully extracted and removed from its respective seat.

In order to avoid accidental removal of the drawer, GB 758,944 discloses a drawer assembly comprising a spring-biased safety catch arm, pivotally mounted on the front of a supporting structure of the drawer assembly and adapted, when the drawer is pulled out from its housing nearly to the full extent, to engage the slot in the flange under the action of the biasing spring so as to obstruct complete withdrawal of the drawer.

The safety catch is provided with a forwardly extending operating arm which is accessible when the drawer is partially withdrawn so that the safety catch may be held manually in the disengaged position to permit complete withdrawal of the drawer.

This solution is quite complex since it is formed by several components, that requires to be assembled during manufacturing of the washing machine. In particular, the catch is fixed to the support structure by a bolt and nut connection, which is requires a relatively complex assembly in particular since it is positioned in a position not easily reachable.

An alternative solution in which a disengageable retaining device of the drawer is provided at an upper wall element or a cover and/or a side wall of the housing of the drawer is described in EP 2 372 011.

SUMMARY OF SELECTED INVENTIVE ASPECTS

An object of aspects of the invention is to provide a laundry washing machine that overcomes the drawbacks of known laundry appliances provided with retaining devices for delimiting the movement of the drawer for the detergent agent or for other agents.

Another object of aspects of the invention is to provide an improved washing machine comprising a retaining device that can be easily fixed to a respective supporting structure during assembling of the washing machine.

A further object of aspects of the invention is to provide a washing machine in which the retaining device of the drawer that can be removed and substituted in case of breakage.

According to aspects of the invention it is provided a washing machine comprising:

- a drawer comprising at least one compartment for receiving an agent for treating laundry;
- a supporting structure on which the drawer can slide; and
- a removable retaining device connectable to the supporting structure such that the removable retaining device delimits a movement of the drawer with respect to the supporting structure when connected to the supporting structure, the removable retaining device being operable in order to allow the withdrawal of the drawer from the supporting structure;

wherein the removable retaining device is connected to the supporting structure by moving the removable retaining device along a fixing direction, and wherein the supporting structure comprises an engagement element and the removable retaining device comprises a releasable locking element engaging with the engagement element such that, when the removable retaining device is moved along the fixing direction in order to be connected to the supporting structure, the releasable locking element locks the retaining device in a connected condition.

It is to be understood that the in the laundry washing machine according to aspects of the invention the removable retaining device can be locked in the operative position, i.e. the position in which it is capable of retaining the drawer, by simply moving it along the fixing direction. In this manner the locking of the removable retaining device can take place with a simple operation, thus allowing performing the assembling of the washing machine in a particularly simple manner. Furthermore, the use of a releasable locking element for the retaining device is advantageous since it allows not only a simple assembly of the washing machine, but also to be removed and, in case, substitute the retaining element.

According to a preferred embodiment, the removable retaining device comprises an attachment portion and the supporting structure comprises a receiving portion into which said attachment portion is engageable in order to connect said removable retaining device to the supporting structure.

In this manner the engagement of the retaining device is even further simplified, since it requires only the insertion of the attachment portion in the receiving portion, during which the locking element locks the retaining device in the supporting structure. Moreover, the manufacturing of both the attachment portion and the receiving portion can be performed in a particularly simple manner.

Preferably, the releasable locking element is formed on the attachment portion. This further improve the easiness of manufacturing of the retaining device, since the locking element can be manufactured as one piece with the retaining element, or it can be fixed thereto before connecting it to the supporting structure.

According to a further preferred embodiment, the engagement element is formed by a recess defined in the receiving portion into which the releasable locking element engages when the attachment portion is moved along the fixing direction in order to be engaged with the receiving portion. This makes even further easier the engagement of the retaining device, since it can be engaged in position by means of a simple shape-coupling and, accordingly, without requiring any tool.

According to a further aspect of the invention, the releasable locking element is elastically deformable in order to be snap-fixed to the engagement element. This allows that, when the retaining device is moved along the fixing direction inside the recess defined in the receiving portion, the locking of the retaining device in the supporting structure occurs automatically and in a particularly simple manner.

Preferably, the recess is a through-opening through which the releasable locking element can be reached in order to be disengaged, thus making the disengagement of the locking element particular easy, since it can be deformed in order to disengage the snap-fixing, or more in general moved towards the disengaged position, through the opening.

According to a preferred embodiment, the fixing direction corresponds to a sliding direction of the drawer. This makes the operation of fixing the retaining device to the supporting structure particularly simple, since, when the drawer is removed, the supporting structure can be easily reached by the hand of a user.

Preferably, the drawer comprises a stopping element and the removable retaining device comprises a catch portion configured to engage with the stopping element in order to delimit the movement of the drawer with respect to the supporting structure; the catch portion is rotatably connected to the attachment portion. In this manner, the disengagement of the retaining device can be achieved in an easy and precise way by rotating the retaining element or by subjecting the retaining device to a movement producing a rotation thereof. Even more preferably, the catch portion is formed as single body with the attachment portion, thus making the manufacturing of the retaining device even further simple.

Even more preferably, the catch portion is formed as single body with the attachment portion, thus making the manufacturing of the retaining device even further simple.

According to a further aspect of the invention, the removable retaining device comprises an operative portion associated to a catch portion such that the catching element is disengaged from the stopping element by operating the operative portion. The operative portion projects from the supporting structure when the releasable locking element is engaged with the engagement element.

In this manner, the retaining element can be simply operated when the drawer is partially extracted from the supporting structure, without requiring introducing the hand in narrow opening or in places barely reachable, since the operative portion is placed in a position that can be easily reached by the hand of the user.

Preferably, the receiving portion is formed by a slot and, even more preferably, the slot is defined on a side wall of the supporting structure in which a guide surface, onto which the drawer can slide, is defined. This makes it possible to fix the retaining device directly on the supporting structure, and, at the same time, to place the former in a position that can be easily reached in order to both withdraw the drawer and remove the retaining device itself.

Even more preferably, the attachment portion is flat-shaped and disposed, in use, parallel to the side wall of the drawer. Always according to a preferred embodiment, the catch portion rotates with respect to the attachment portion about an axis parallel to the attachment portion. These features allow a very compact solution for the positioning of the retaining device, since it can be positioned alongside of the drawer, and, at the same time, allow a particularly easy manufacturing thereof.

According to a preferred embodiment, the rotation axis of the catch portion is perpendicular to the fixing direction. In this manner, when the retaining device is positioned alongside of the drawer, it can be easily rotated or more in general operated by means of the thumb or the fingers of the user while the drawer is hold with the hand.

BRIEF DESCRIPTION OF THE DRAWINGS

These and other features and advantages of the invention will be better apparent from the following description of some exemplary and non-limitative embodiments, to be read with reference to the attached drawings, wherein.

DETAILED DESCRIPTION OF EXAMPLE EMBODIMENTS

Figure 1:
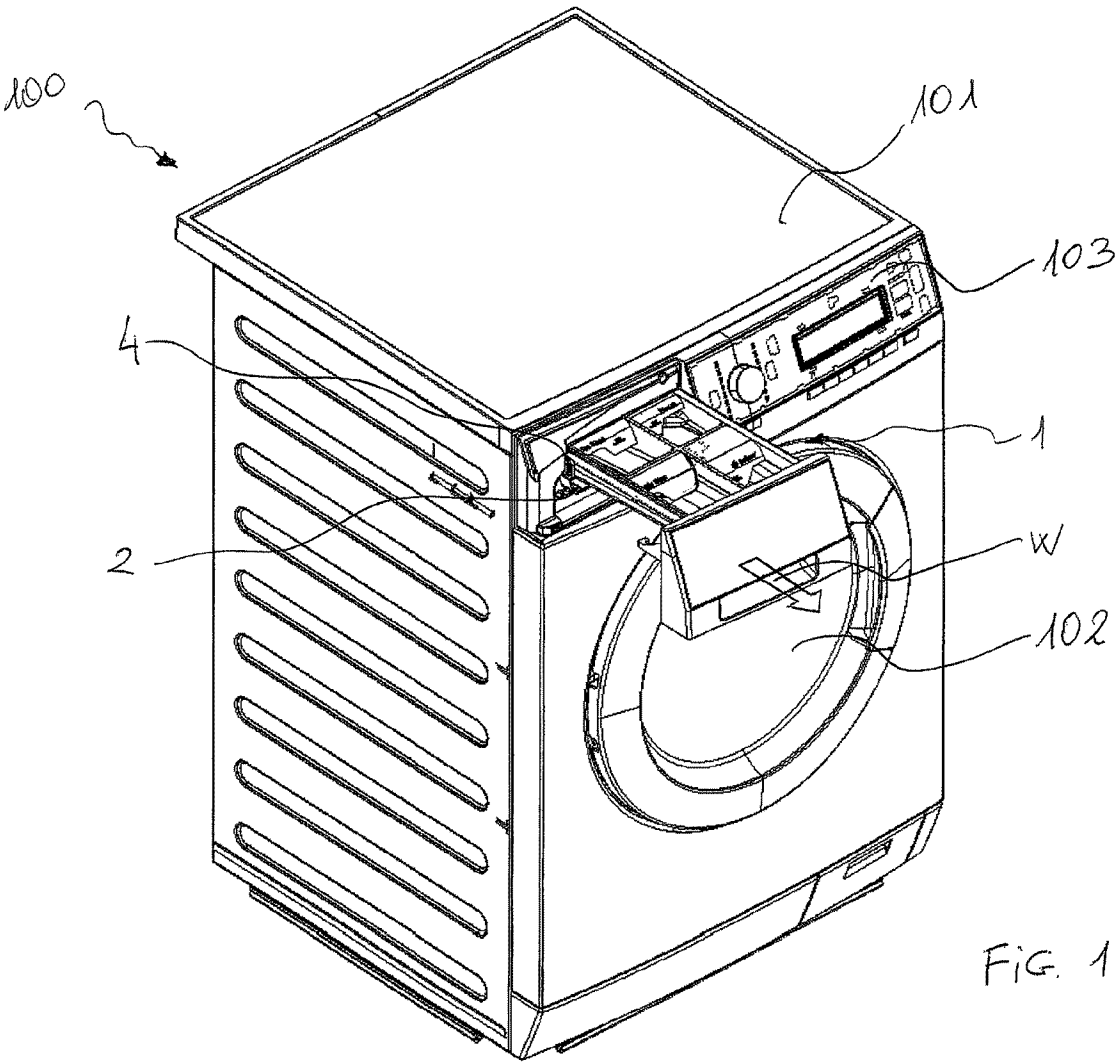
FIGS. 1 and 1A are a front perspective view of the washing machine of aspects of the present invention, in which a drawer is partially withdrawn from a respective supporting structure, and a detail thereof, respectively.

With reference initially to FIG. 1, a laundry washing machine realized according to aspects of the present invention is globally indicated with the reference number 100.

It should be noted that in the context of the present application with the expression "washing machine" is referred both to a "standard" washing machine, configured only for washing and rinsing the laundry, and to a washer-drier, which is configured for washing, rinsing, and also for drying the laundry. The washing machine 100 comprises an outer casing 101, preferably but not necessarily parallelepiped-shaped, and a treatment chamber for receiving the laundry and in general the clothes and garments to be washed and/or dried.

An aperture is defined in a front bulkhead of the casing, facing the treatment chamber and thus allowing loading and unloading the laundry in the machine. The washing machine 100 further comprises a door assembly 102, preferably pivotally supported on the casing 101 and displaceable between a closed position, shown in FIGS. 1 and 2 and in which the aperture is closed or preferably sealed, and an open position in which access to the drum is granted.

According to the present embodiment, in the front face of the casing 101 are also located a control panel 103 of the machine 100 and a drawer 1 suitable for containing detergents and other agents for treating the laundry, such as softener or bleach.

In other words, the device 100 according to present embodiment is a front-load device. Nevertheless it will be appreciated that aspects of the present invention could also apply to different type of washing laundry machines, such as top-loading ones.

The drawer 1 is slidably associated to a supporting structure 2, preferably formed by a receptacle in which the drawer 1 can be housed. As it will be better shown in the following, according to a preferred embodiment, the supporting structure 2 defines a housing 20, better shown in FIGS. 2 and 2A, capable of receiving therein the drawer 1 such that when the drawer is fully inserted in the housing, a front panel 15 of the drawer is flush with the front bulkhead of the casing. Preferably, the front panel 15, or more in general the drawer 1, comprises a handle 16, by means of which the drawer 1 can be pulled and extracted from the housing.

Figure 1A:
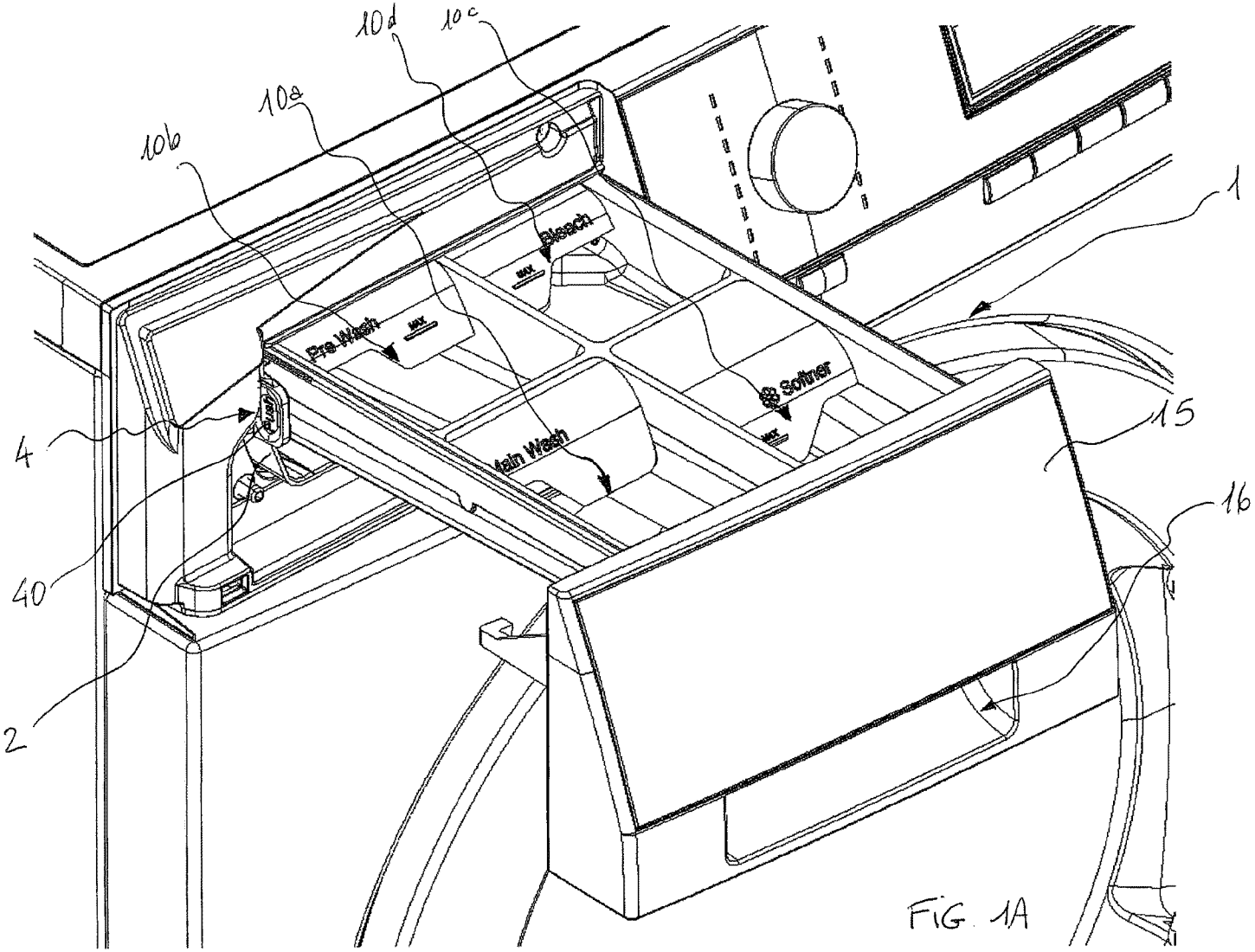

FIGS. 1 and 1A depict the drawer 1 in a partially withdrawn position, in which compartments 10*a*, 10*b*, 10*c* and 10*d*, configured for receiving the detergents and other agents, are at least partially extracted from the receptacle 2. In this position, the detergents and the other agents can be poured inside the compartments 10*a*, 10*b*, 10*c* and 10*d*.

The movement of the drawer 1 along the withdrawal direction, shown by arrow W in the Figures, is limited by a removable retaining device 4. The removable retaining device 4 engages with a stopping element 3 of the drawer 1, shown in FIG. 2A, in order to delimit the movement of the drawer 1 with respect to the supporting structure 2, such that full removal of the drawer 1 is prevented, as will be better explained in the following.

In this position, which is depicted in FIGS. 1 and 1A, the drawer 1 is still associated to the supporting structure 2, such that the drawer does not tilt or fall due to the gravity.

Figure 2:
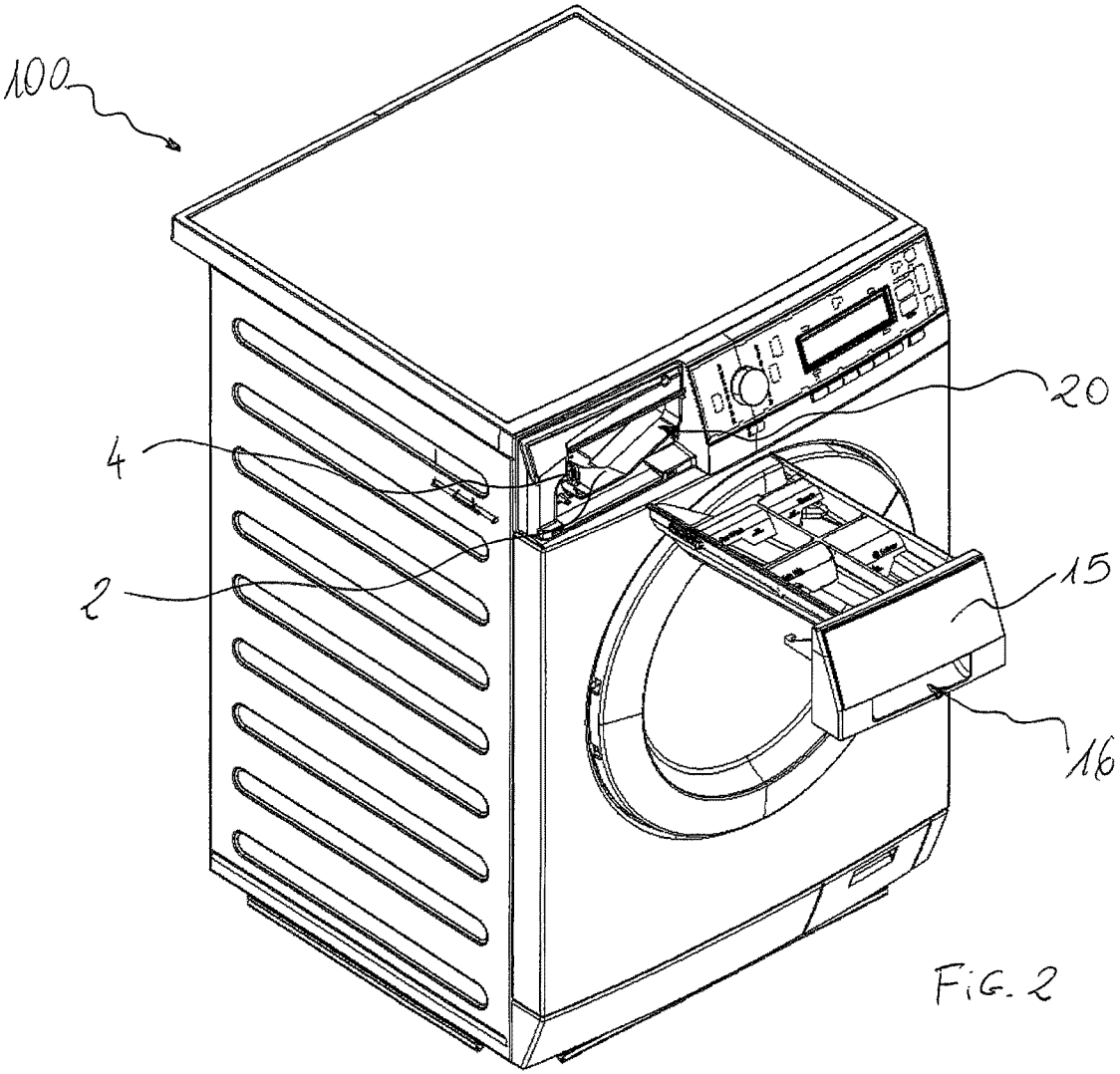
FIGS. 2 and 2A are a front perspective view of the washing machine of FIG. 1, in which the drawer is removed from the supporting surface, and a detail thereof, respectively.
Figure 2A:
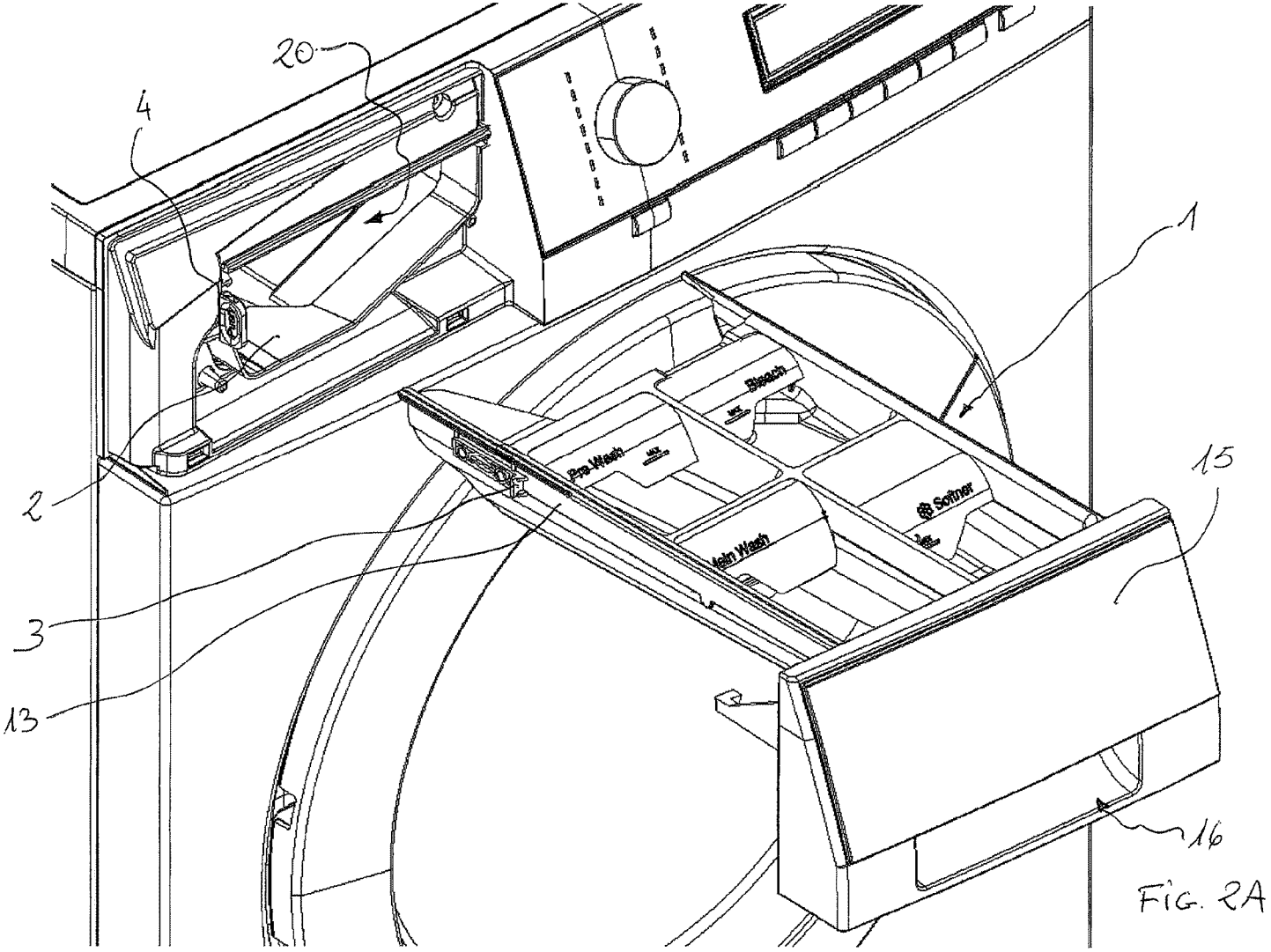

With reference to FIGS. 2 and 2B, when the retaining device 4 is disengaged, the drawer is freely slidable on the supporting structure 2 along the sliding direction S, corresponding to the withdrawal direction W, and it can be pulled further in order to remove it from the housing defined by the supporting structure.

Figure 3:
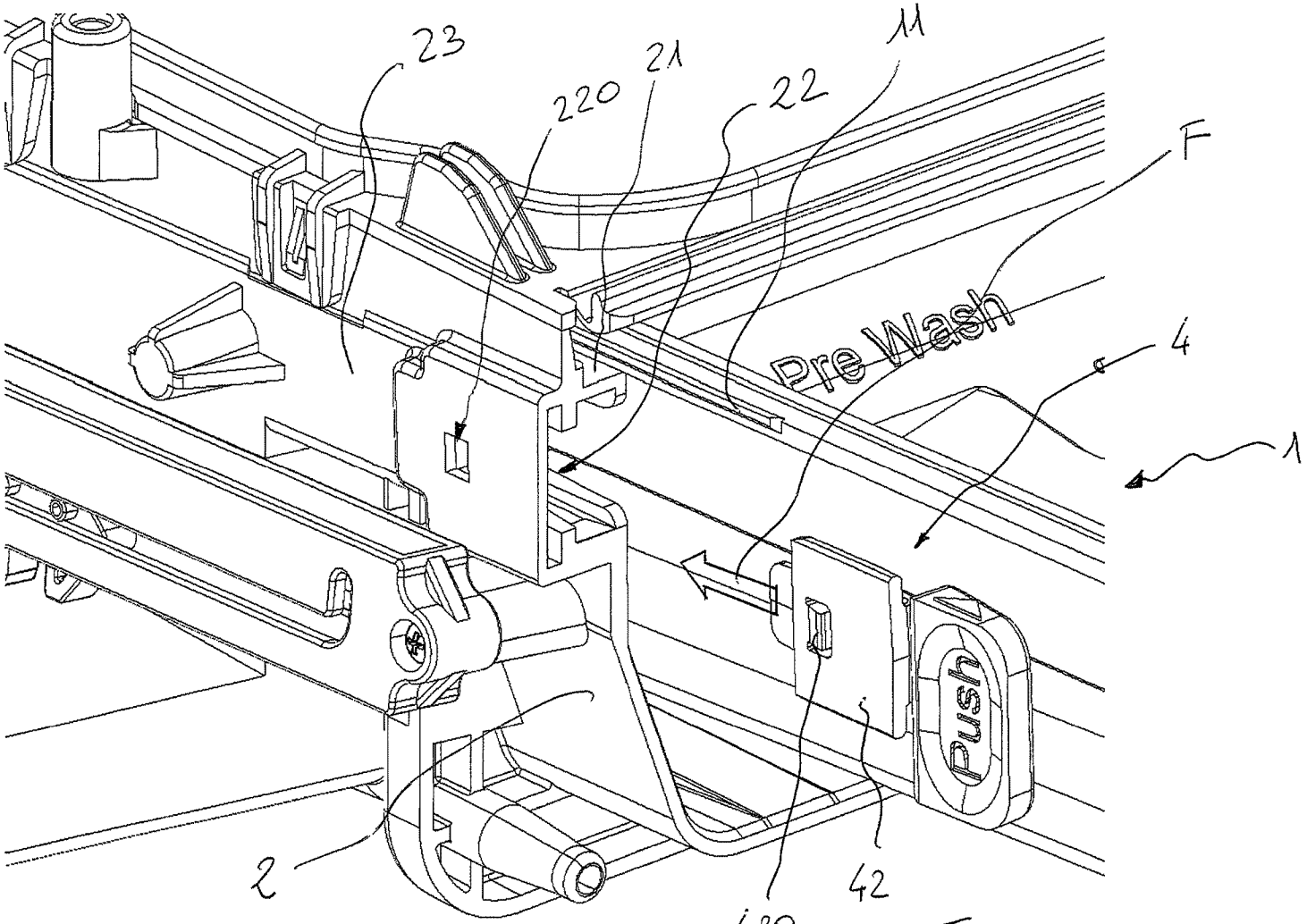
FIG. 3 is a front perspective view, in detail, of the drawer, the supporting structure and a removable resilient device of the washing machine according to aspects of the present invention, in which the drawer is partially withdrawn and the removable resilient device is removed from the supporting structure.
Figure 4:
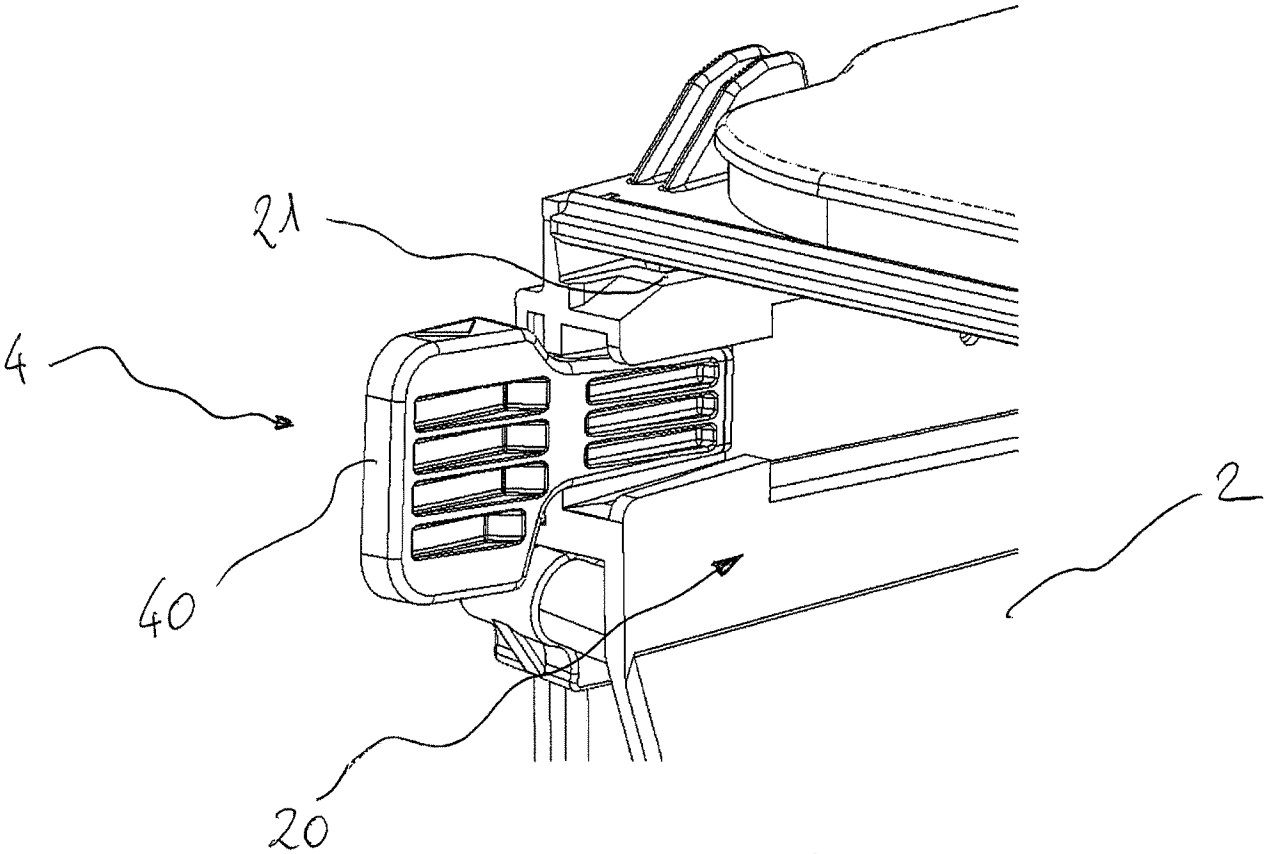
FIG. 4 is a front perspective view of the supporting structure and of the removable resilient device of FIG. 3, according to a different perspective.
Figure 5A:
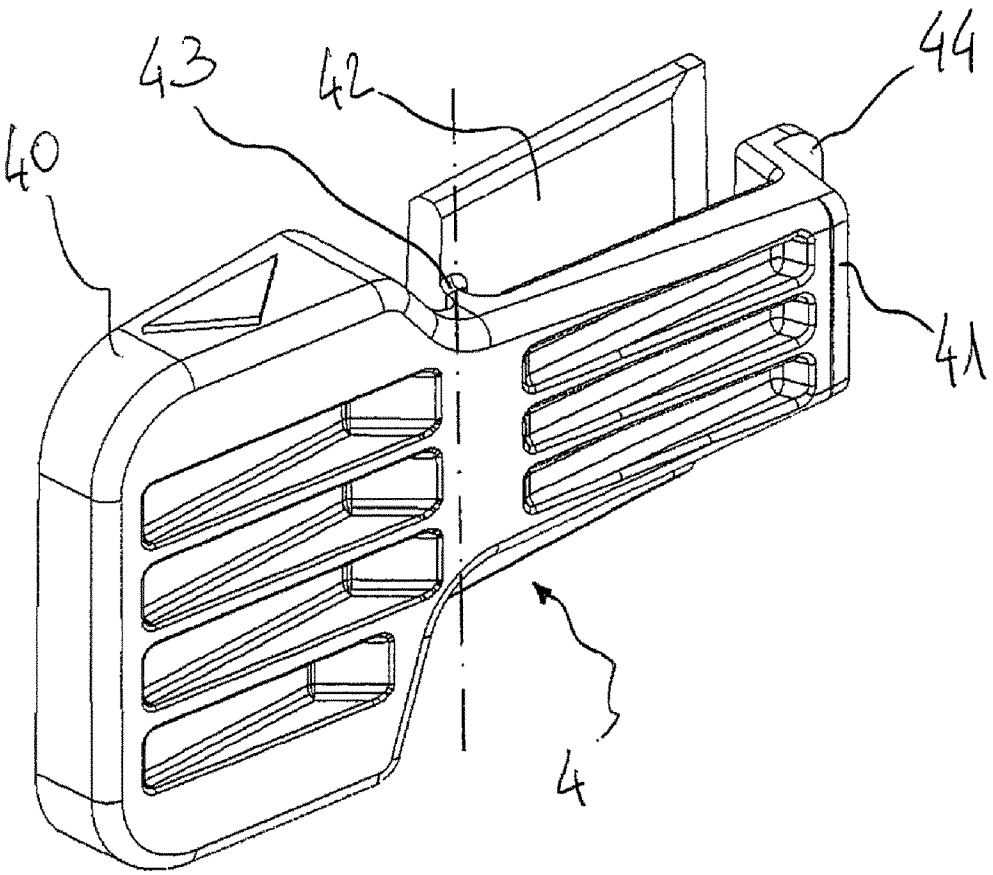
FIGS. 5A, 5B and 5C are different perspective views of the removable resilient device of FIG. 3.
Figure 5B:
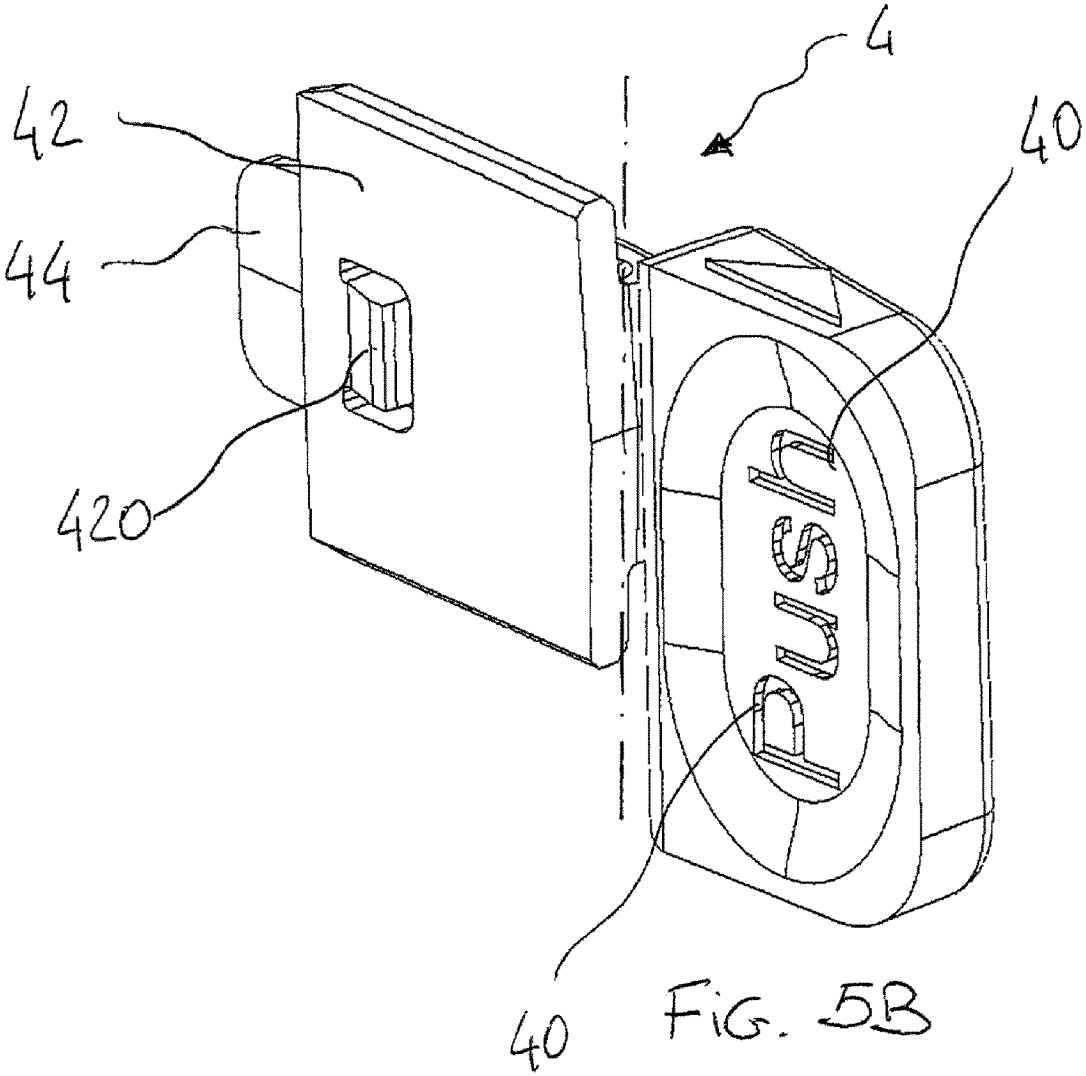
Figure 5C:
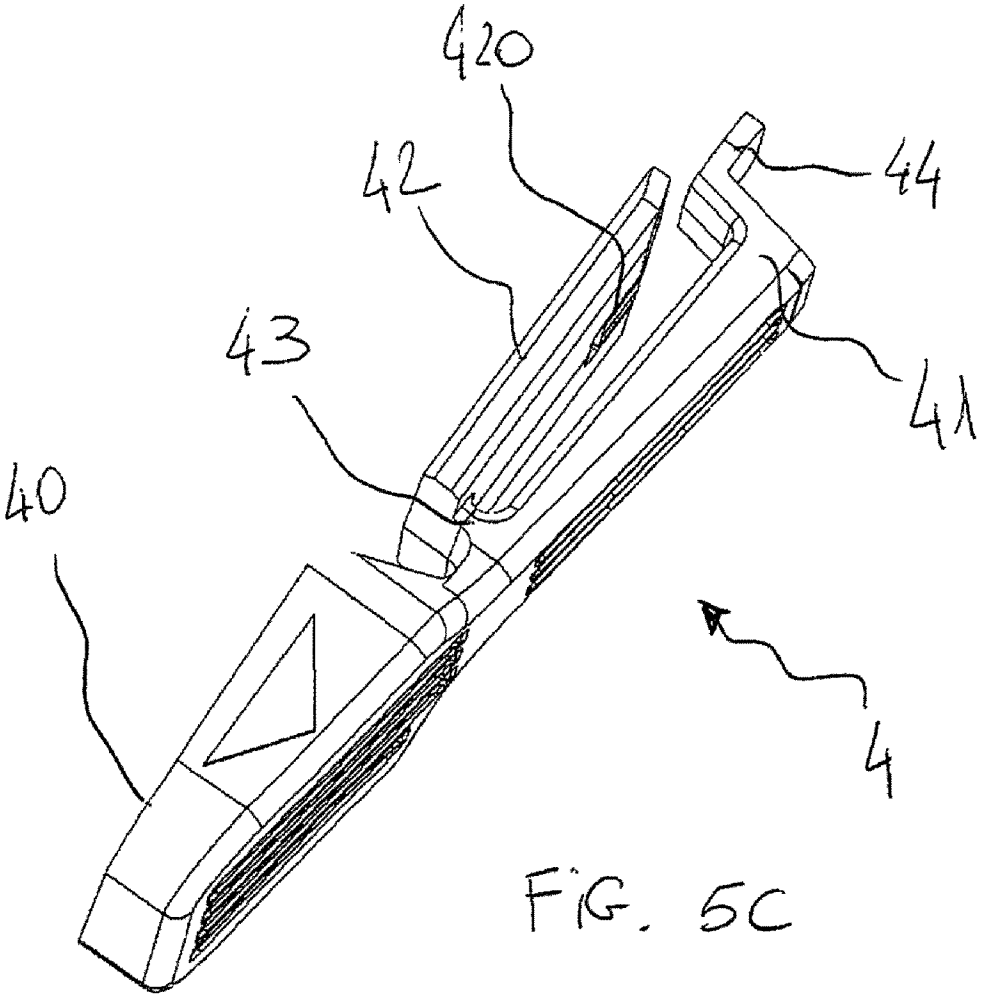

Preferably, in order to allow sliding of the drawer 1 on the supporting structure 2, the former comprises a laterally projecting sliding surface 11 configured to slide on a respective guide member 21 of the supporting structure 2, shown in FIG. 3.

Figure 6A:
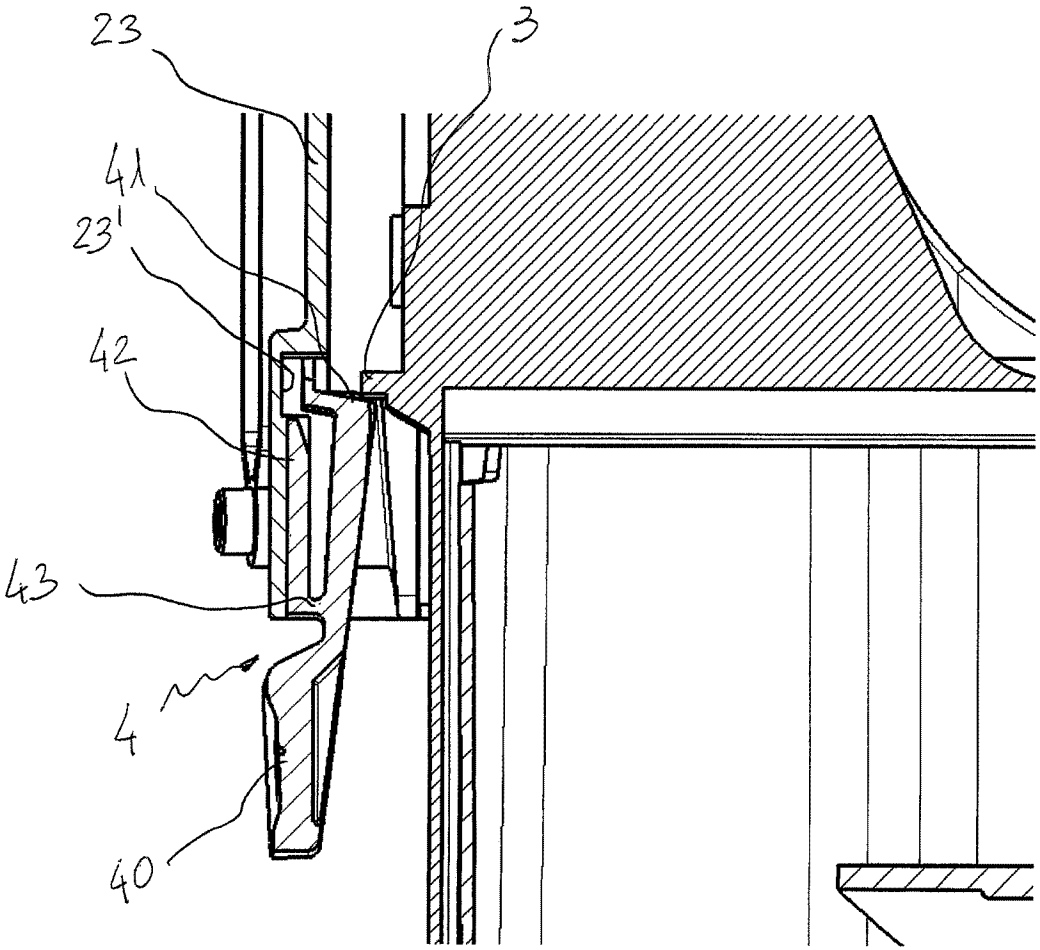
FIGS. 6A, 6B and 6C are a top sectional view, showing the drawer, the supporting structure and the removable resilient according to three different operative configurations.

As previously explained, sliding of the sliding surface 11 on the guide member 21 along the sliding direction S is limited by the retaining device 4. According to a preferred embodiment, the drawer 1 comprises a stopping element 3, preferably connected to a side wall 13 of the drawer 1 which can engage with a catch portion 41 formed in the removable retaining device 4, as shown in FIG. 6A.

The stopping element 3 and the catch portion 41 are shaped and positioned such that, when the drawer 1 is extracted from the housing 20 defined in the supporting structure 2 for a certain extent, they engage the one with other, thus preventing further withdrawal of the drawer 1 and delimiting the movement of the drawer 1 with respect to the supporting structure 2.

Figure 6B:
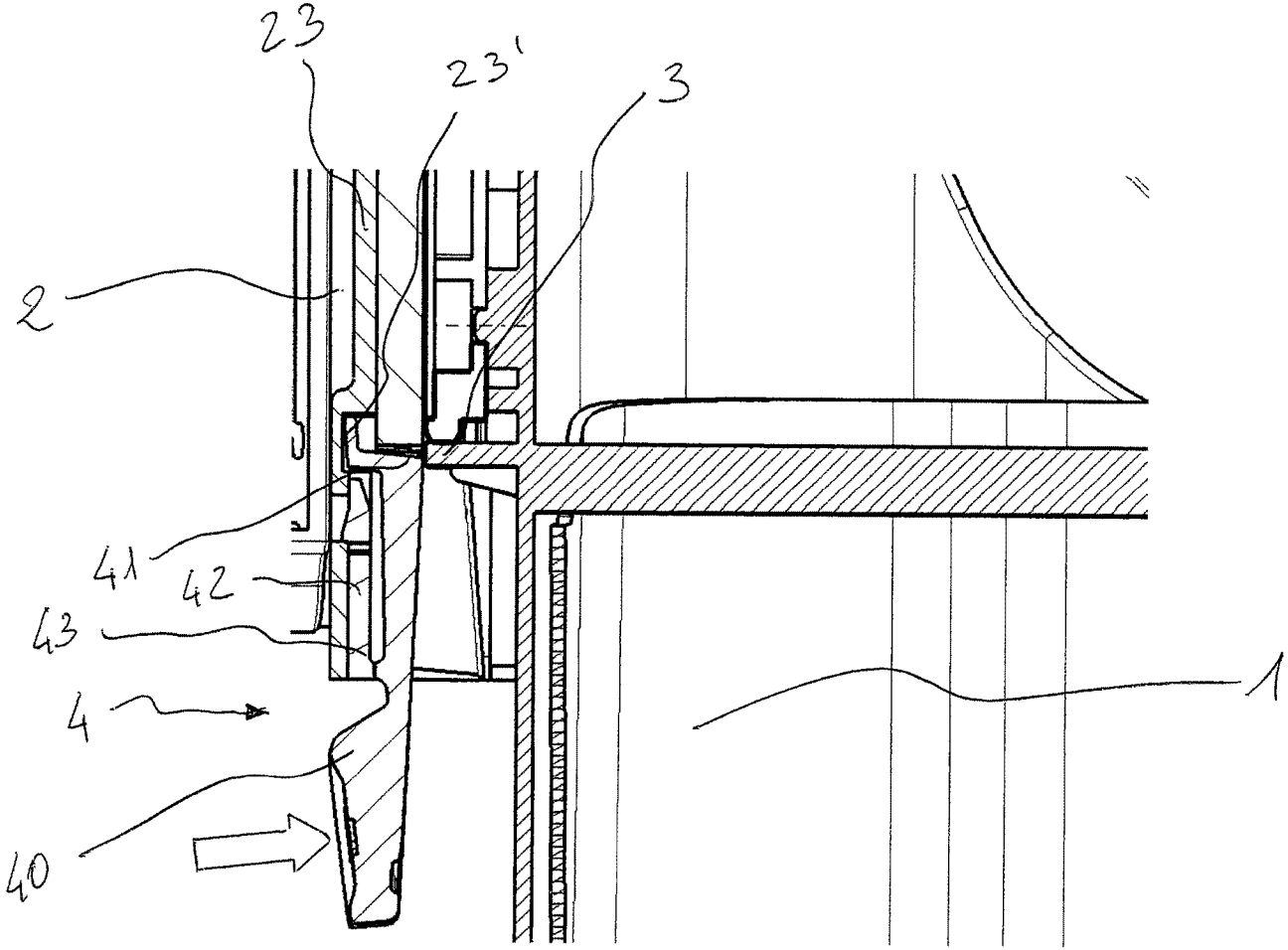
Figure 6C:
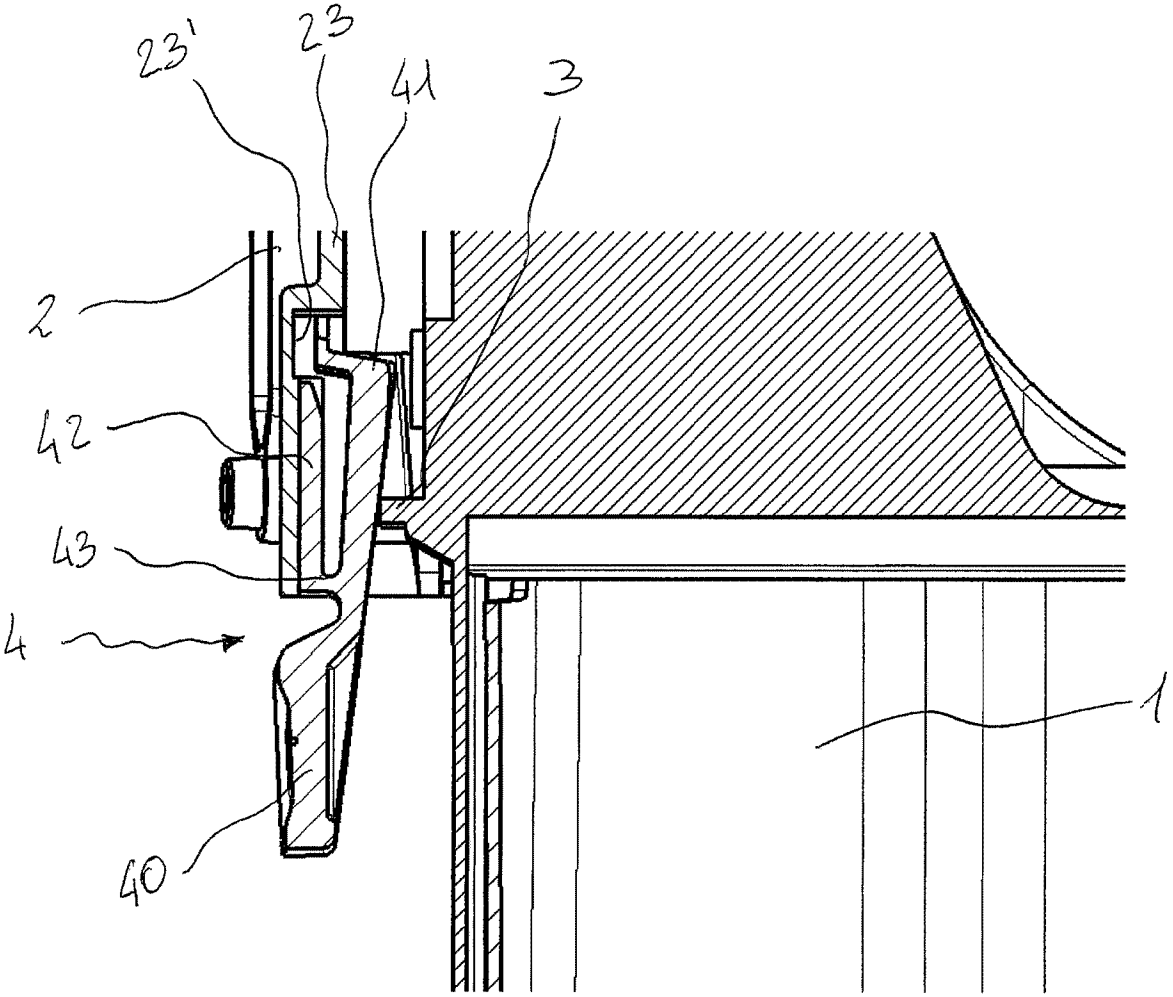

As it will be described in further detail in the following, the catch portion 41 can be displaced in order to be disengaged from the stopping element 3, thus disengaging the retaining device 4 and allowing a complete withdrawal of the drawer 1, as shown in FIGS. 6B and 6C.

With reference to FIG. 3, the removable retaining device 4 is connectable to the supporting structure 2, preferably to a side wall 23 thereof, in order to be fixed thereto.

According to a preferred embodiment, the removable retaining device 4 comprises an attachment portion 42 and the supporting structure 2 comprises a respective receiving portion 22 into which the attachment portion 42.

Preferably, the receiving portion 22 is formed by a slot defined on the side wall 23 of the supporting structure 2. The attachment portion 42 is flat-shaped and disposed, in use, parallel to the side wall 23 of the drawer 1. Accordingly, in the present embodiment, the retaining device 3 can be connected to the supporting structure 2 by inserting the flat-shaped attachment portion 42 into the slot 22. Always according to a preferred embodiment, the flat-shaped attachment portion 42 is inserted into the slot 22 by sliding the retaining element 4 along a fixing direction F, preferably parallel to the withdrawal direction of the drawer 1.

As shown in FIGS. 6A-6C, showing the removable retaining device 4 in detail, according to a preferred embodiment the catch portion 41 is connected to attachment portion 42 by means of a resilient connection 43. Preferably, the resilient connection 43 is located at an edge of the catch portion 41. Accordingly, the resilient connection 43 allows the catch portion 41 to rotate with respect to the attachment portion 42 about an axis X parallel to the attachment portion 42 and, preferably, perpendicular to the fixing direction F. As it can be seen from FIGS. 6A-6C, the rotation of the catch portion 41 allows to displace it from the engaged position, in which movement of the drawer 1 is delimited, to the disengaged one, in which the drawer 1 can be fully extracted.

Preferably, the catch portion 41 is formed as single body with said attachment portion 42 and they are made of plastic e.g. by molding. It is will be appreciated that, particularly when the resilient element is formed as a single body, the movement of the catch portion 41 relative to the attachment portion 42 can differ from a perfect rotation about the axis X, and it can be e.g. formed by a translational movement composed of a rotation and a linear translation or a rotation about a non-fixed axis.

According to a preferred embodiment, in order to operate the catch portion 41, the retaining element 4 comprises an operative portion 40, symmetric to the resilient connection 43. Therefore, when the operative portion 40 is pushed by the thumb or the finger of the user, the catch portion 41 is displaced from the engaged position to the disengaged one.

Preferably, the retaining device 4 comprises an extension 44, projecting towards the attachment portion 42 from an end of the catch portion 41 opposite to the one connected to the resilient connection 43. When the attachment portion 42 is rotated by operating the operative portion 40 for a certain extent, the extension 44 abuts against an internal surface 23' of the side wall 23. In this manner, the rotation, or more in general the displacement, of the attachment portion 42 can be limited, thus avoiding excessive efforts on the resilient connection 43.

With reference to FIG. 3, the removable retaining device 4 comprises a releasable locking element 420, for locking the retaining device 4 in the slot 22 in a position such that it can delimit the movement of the drawer 1 as previously explained. Also, when the removable retaining device 4 is locked in position by the releasable locking element 420, the operative portion 40 projects from the supporting structure 2, in order to be easily reachable.

As shown in FIG. 3, the releasable locking element 420 is formed such that, when the removable retaining device 4 is moved along the fixing direction F in order to be inserted in the slot 20 and connected to the supporting structure 2, the releasable locking element 420 is automatically engaged with an engagement element 220 provided on the slot 20 or, more in general, on the supporting structure 2.

More precisely, according to the present embodiment, when the retaining element 4 is moved along the fixing direction F in order to be inserted in the slot 20, the releasable locking element 420 engages with the engagement element 220 without requiring further operations, such as the use of other components or of any tool.

Preferably, the releasable locking element 420 is formed by an elastically deformable projection, that is deformed by abutting against an internal surface of the slot 22 when inserted therein. According to the present embodiment, the engagement element 220 comprises a recess, defined on such internal surface of the slot 22, into which the projection 420 engages as it reaches it. In other words, the releasable locking element 420 is snap-fixed to the engagement element 220 when moved into the slot 22 along the fixing direction F.

According to a preferred embodiment, the recess 220 is a through-opening through which said releasable locking element 420 can be reached in order to be disengaged. This can be done e.g. by using the tip of a tool, such as a small screwdriver, and urging the locking element 420 through the through opening in order to be disengaged therefrom.

Accordingly, it will be appreciated that the retaining element 4 can be easily removed and substituted in case of breakage.

Furthermore, the retaining device 4 of the washing machine of aspects the present invention can be advantageously made of a different material than the supporting structure, thus allowing the use of materials more suitable for providing a proper deformability to the resilient connection 43 and, eventually, having a different color in order to be clearly identify.

The invention claimed is:

1. A washing machine comprising:

a drawer comprising at least one compartment for receiving an agent for treating laundry, and a stopping element connected to a side wall of the drawer;

a supporting structure on which said drawer can slide; and a removable retaining device connected to said supporting structure such that said removable retaining device delimits a movement of said drawer with respect to said supporting structure when connected to said supporting structure, said removable retaining device being operable in order to allow the withdrawal of said drawer from said supporting structure;

wherein said removable retaining device is connected to said supporting structure by moving said removable retaining device along a fixing direction (F), wherein said supporting structure comprises an engagement element and said retaining device comprises a releasable locking element engaging with said engagement element when said removable retaining device is moved along said fixing direction (F) in order to be connected to said supporting structure such that said releasable locking element locks said removable retaining device in a connected condition.

2. The washing machine according to claim 1, wherein said removable retaining device comprises an attachment portion and said supporting structure comprises a receiving portion into which an attachment portion is engageable in order to connect said removable retaining device to said supporting structure.

3. The washing machine according to claim 2, wherein said releasable locking element is formed on said attachment portion.

4. The washing machine according to claim 2, wherein said engagement element is formed by a recess defined in said receiving portion into which said releasable locking element engages when said attachment portion is moved along said fixing direction (F) in order to be engaged with said receiving portion.

5. The washing machine according to claim 4, wherein said recess is a through-opening through which said releasable locking element can be reached in order to be disengaged.

6. The washing machine according to claim 1, wherein said releasable locking element is elastically deformable in order to be snap-fixed to said engagement element.

7. The washing machine according to claim 6, wherein said recess is a through-opening through which said releasable locking element can be reached in order to be disengaged.

8. The washing machine according to claim 1, wherein said fixing direction (F) corresponds to a sliding direction (S) of said drawer.

9. The washing machine according to claim 1, wherein said removable retaining device comprises a catch portion configured to engage with said stopping element in order to delimit said movement of said drawer with respect to said supporting structure, said catch portion being rotatably connected to an attachment portion of the removable retaining device.

10. The washing machine according to 9, wherein said catch portion is formed as a single body with said attachment portion via a resilient connection located at an edge of the catch portion.

11. The washing machine according to claim 10, wherein said catch portion rotates, via the resilient connection, with respect to said attachment portion about an axis (X) parallel to said attachment portion.

12. The washing machine according to claim 11, wherein said rotation axis (X) is perpendicular to said fixing direction (F).

13. The washing machine according to claim 9, wherein said removable retaining device comprises an operative portion associated with the catch portion such that said catch portion is disengaged from said stopping element when said operative portion is pressed, and wherein said operative portion projects from said supporting structure when said releasable locking element is engaged with said engagement element.

14. The washing machine according to claim 9, wherein said catch portion rotates with respect to said attachment portion about an axis (X) parallel to said attachment portion.

15. The washing machine according to claim 14, wherein said rotation axis (X) is perpendicular to said fixing direction (F).

16. The washing machine according to claim 1, wherein said receiving portion is formed by a slot.

17. The washing machine according to claim 16, wherein said slot is defined on a side wall of said supporting structure in which a guide surface, onto which said drawer can slide, is defined.

18. The washing machine according to claim 17, wherein said attachment portion is flat-shaped and disposed, in use, parallel to said side wall of said drawer.

* * * * *